US009506642B2

(12) United States Patent
Qin

(10) Patent No.: US 9,506,642 B2
(45) Date of Patent: Nov. 29, 2016

(54) LED LIGHT MODULE AND LED CHIP

(75) Inventor: Biao Qin, Shenzhen (CN)

(73) Assignee: Shenzhen Qin Bo Core Technology Development Co., Ltd., Shenzhen, Guangdong Province (CN)

( * ) Notice: Subject to any disclaimer, the term of this patent is extended or adjusted under 35 U.S.C. 154(b) by 221 days.

(21) Appl. No.: 13/992,207

(22) PCT Filed: Mar. 1, 2011

(86) PCT No.: PCT/CN2011/071417

§ 371 (c)(1),
(2), (4) Date: Jun. 6, 2013

(87) PCT Pub. No.: WO2012/088790

PCT Pub. Date: Jul. 5, 2012

(65) Prior Publication Data

US 2013/0258669 A1 Oct. 3, 2013

(30) Foreign Application Priority Data

Dec. 27, 2010 (CN) ..... 2010 1 0623452

(51) Int. Cl.

| | |
|---|---|
| ***F21V 29/70*** | (2015.01) |
| ***F21V 29/00*** | (2015.01) |
| ***F21K 99/00*** | (2016.01) |
| ***F21V 25/00*** | (2006.01) |
| ***F21V 29/89*** | (2015.01) |
| *F21Y 101/02* | (2006.01) |

(52) U.S. Cl.

CPC ..... *F21V 29/22* (2013.01); *F21K 9/00* (2013.01); *F21V 25/00* (2013.01); *F21V 29/70* (2015.01); *F21V 29/89* (2015.01); *F21Y 2101/02* (2013.01)

(58) Field of Classification Search

CPC .... F21S 4/001; F21S 4/003; F21W 2121/00; F21Y 2121/02; F21V 29/004

USPC ..... 362/249.01, 249.02

See application file for complete search history.

(56) References Cited

U.S. PATENT DOCUMENTS

| | | | | |
|---|---|---|---|---|
| 4,757,235 | A * | 7/1988 | Nunomura et al. | 313/509 |
| 4,841,409 | A * | 6/1989 | Kalwar | 361/230 |
| 6,122,042 | A * | 9/2000 | Wunderman | A61B 1/05 356/343 |
| 2003/0066220 | A1* | 4/2003 | Velez | 40/544 |
| 2006/0289892 | A1* | 12/2006 | Lee et al. | 257/103 |
| 2007/0224821 | A1* | 9/2007 | Koyata | B24B 37/042 438/691 |
| 2007/0241422 | A1* | 10/2007 | Chen | 257/528 |
| 2009/0154166 | A1* | 6/2009 | Zhang et al. | 362/294 |
| 2010/0240158 | A1* | 9/2010 | Ter-Hovhannissian | 438/27 |
| 2011/0001157 | A1* | 1/2011 | McKenzie et al. | 257/98 |
| 2011/0057226 | A1* | 3/2011 | Oberleither et al. | 257/98 |
| 2011/0114830 | A1* | 5/2011 | Reijonen | H01J 35/04 250/251 |
| 2011/0248615 | A1* | 10/2011 | Tsai | 313/46 |
| 2011/0304990 | A1* | 12/2011 | Lim et al. | 361/717 |

* cited by examiner

*Primary Examiner* — Jong-Suk (James) Lee
*Assistant Examiner* — Mark Tsidulko
(74) *Attorney, Agent, or Firm* — Novoclaims Patent Services LLC

(57) ABSTRACT

An LED light module and an LED chip are provided. LED wafers (1) are provided on one side of a heat spreading plate (3) made of copper, aluminum or copper-aluminum composite material with a thickness of more than 0.4 mm and with an area of 5 times of the sum area of the LED wafers larger to reduce the heat-flux density. A high-voltage insulation plate (2) made of a ceramic wafer with a thickness of more than 0.15 mm is provided on the other side of the heat spreading plate (3). The heat spreading plate (3) is separated and insulated by an outer layer insulator (4) with the high-voltage insulation plate (2). This kind design can effectively reduce the internal conduction thermal resistance and raise the insulation strength, and the manufacturing cost can be reduced effectively also.

20 Claims, 2 Drawing Sheets

LED LIGHT MODULE AND LED CHIP

BACKGROUND OF THE PRESENT INVENTION

1. Field of Invention

The present invention relates to the LED technical field, and more particularly to an LED package structure for reducing the internal heat conduction resistance of an LED light module or an LED chip as well as raising the insulation strength thereof.

2. Description of Related Arts

One of the most important applications of LED technology is the light illumination. The LED light illumination is considered to be the green illumination technology for the next generation of human beings. However, the manufacturing costs of LED illumination products are still high, so that the widely application thereof is hindered. The heat dissipation should be responsible for the high manufacturing costs of LED illumination products. The LED heat dissipating process comprises an internal heat conduction process, and an external heat transfer process of air convection (and/or radiation). The present invention only relates to the internal heat conduction process.

The internal heat conduction thermal resistance of a current LED chip accounts for a relatively large portion of the total heat transfer process thermal resistance. A current product has a thermal resistance of at least 6° C./W. The amount will be at least 10° C./W considering the thermal resistance of the insulation layer on the aluminum base plate. The aim for addressing the electrical insulation problem within the chip should be responsible for the high internal conduction thermal resistance. Even the internal conduction thermal resistance is as high as the amount mentioned above, the electrical insulation strength thereof is less than 2,000V. The thermal resistance must be higher for obtaining higher and safer electrical insulation strength. There is suggestion which is to adopt a high heat conduction ceramic (such as AIN ceramic) as the heat sink of the LED chip for solving the contradiction between the insulation and heat conduction issue. However, the manufacturing costs of AIN like high heat conduction ceramics are high.

The modularization and standardization of light source is the inevitable development orientation of LED light illumination. A Chinese patent (patent No. ZL2009201340352, an LED lamp core and LED illumination lamp thereof) adopts a conical or tapered spiral column structure to solve the problem of contact heat transfer between the LED light module and the lamp (radiator). But the contradiction between the electrical insulation and heat conduction issue from the LED wafer to the heat conductive core (lamp) remains to be solved.

SUMMARY OF THE PRESENT INVENTION

The main object of the present invention is to solve the problem of the internal heat conduction as well as the electrical insulation (especially high voltage insulation) of the LED light module and LED chip, a novel configuration which is based on the principle theory of heat transfer is provided, so as to obtain high voltage insulation and meet higher electro-security regulations while reduce the internal heat conduction thermal resistance in order to significantly reduce the total manufacturing costs without the need for adopting expensive AIN like high heat conduction ceramics.

Additional advantages and features of the invention will become apparent from the description which follows, and may be realized by means of the instrumentalities and combinations particularly point out in the appended claims.

According to the present invention, the foregoing and other objects and advantages are attained by an LED light module comprising: a plurality of LED wafers, a heat dispreading plate, an outer insulator, a high-voltage insulation plate, and a thermal conductive core, wherein a contact heat transfer surface of the thermal conductive core for transferring the heat to outside adopts a conical or a tapered spiral column structure. The LED light module of the present invention has the following character features: The LED wafers are set on one face of the heat spreading plate which is defined as Face A of the heat dispreading plate, wherein the heat dispreading plate adopts copper or aluminum material or copper-aluminum composite material, wherein the area of the heat dispreading plate is five times larger than the sum area of the LED wafers on the heat dispreading plate, wherein the thickness of the heat dispreading plate is larger than 0.4 mm. The high-voltage insulation plate is set between the other face which is defined as Face B of the heat dispreading plate and an end face (i.e. heat leading-in face of the thermal conductive core, so called heat absorption face) of the thermal conductive core. The high-voltage insulation plate adopts a ceramic wafer which is sintered into ceramics, with a thickness of more than 0.15 mm. The outer insulator is arranged around the peripheral sidewall of the heat dispreading plate and is connected with the high-voltage insulation plate, the whole outer circumferential edge and Face B of said heat dispreading plate are surrounded by said outer insulator and said high-voltage insulation plate so as to be insulated and separated.

The thermal conductive cores adopts a conical or a tapered spiral column structure, so as to effectively solve the problem of contact heat transfer between the module and the radiator, as disclosed in the Chinese patent (patent No. ZL2009201340352, an LED lamp core and LED illumination lamp thereof).

Since the area of the LED wafers is small, and a high heat flux density is produced, so that a high heat conduction temperature difference is formed between the LED wafer and the thermal conductive core (heat dissipation plate). The heat conduction temperature difference (i.e. thermal resistance) is directly proportional to the heat flux density and the heat conduction distance, but inversely proportional to the thermal conductivity of the material. The insulation materials have a relatively low thermal conductivity (except AIN like high thermal conduction ceramics) which is a plurality ten times smaller than copper and aluminum. When adopting a wafer with a size of 1×1 mm and a thermal power of 1 W, the heat flux density will be $10^6$ W/m$^2$. When using the structure of the current products, an alumina ceramic plate (thermal conductivity of 20 W/m·k) with a thickness of 0.15 mm are used as the insulation plate, the wafers are directly set on the ceramic plate, the insulation strength can be 1500V while the heat conduction temperature difference will be 7.5° C.

According to the present invention, the wafers are set on the heat dispreading plate which is made of copper or aluminum. The high-voltage insulation plate which is responsible for providing a high voltage insulation performance is set between the heat dispreading plate and thermal conductive core. When adopting a wafer with a size of 1×1 mm and a thermal power of 1 W, and an alumina ceramic wafer (thermal conductivity of 20 W/m·k) with a thickness of 0.15 mm are used as the high-voltage insulation plate, i.e. maintaining the same insulation strength, but the heat flux density will reduce after passing through the heat dispreading plate. When the heat flux density is reduced five times, the heat conduction temperature difference on the high-voltage insulation plate will be reduced to 1.5° C., and thus the thermal resistance is significantly reduced. The design concept of the prevent invention is that not consider the electrical insulation (high-voltage insulation) between the LED wafers and the heat dispreading plate first, but to reduce the heat flux density first, and then apply the high-voltage insulation, so as the internal conduction thermal resistance can be reduced significantly. The heat dispreading plate which is made of metal electric conductive material has no insulation or low insulation strength with the wafers, so that the high-voltage insulation of the heat dispreading plate becomes the main issue.

Although the heat dispreading plate of the present invention has a similar heat conduction process similar to the heat sink of the current products, the present invention firstly introduce and emphasize the important effect: heat spreading effect, so that it is defined as heat dispreading plate. The current LED industry is not clear about the concept and the importance of heat dispreading and heat-flux density decreasing. Since the thermal conductivity of copper and aluminum is high but the price is lower, so that the heat dispreading plate is preferred to be made of copper or aluminum, or copper-aluminum composite material.

The heat dispreading plate which is used for heat dispreading not only needs to adopt a material with a high thermal conductivity, but also the area and thickness thereof should be large enough. The area of the heat dispreading plate should be five times larger than the sum area of the LED wafers on the heat dispreading plate so that the heat-flux density can be reduced five times, preferably ten times in practical applications, the thickness of the heat dispreading plate should be larger than 0.4 mm by means of calculation and analysis by synthesis. The aim and effect of a thick heat dispreading plate is to effectively spread the heat in the heat dispreading plate so as to reduce the heat flux density.

LED wafers are preferably directly soldered on the heat dispreading plate. Since the connection between the LED wafers and the heat dispreading plate has a high heat flux density, the thermal conductivity of the material at the connection should be high enough. The thermal conductivity of the metal material is high, for example, the thermal conductivity of tin is 60 W/m·k which is several times larger than the thermal conductivity of the heat conduction adhering glue (e.g. fulmargin).

The ceramic wafer which is sintered into ceramics is compact in substance and has high insulation strength and enough high thermal conductivity, so that the present invention adopts the ceramic wafer which is sintered into ceramics as the high-voltage insulation plate. The alumina ceramic wafer has low manufacturing costs and enough high thermal conductivity, the thermal conductivity of 96 alumina ceramics can be 20 W/m·k, so that it is a first choice of the material for the high-voltage insulation plate.

The thickness of the ceramic wafer of the high-voltage insulation plate of the present invention is not less than 0.15 mm. From one aspect considering the difficulty of the manufacturing process, the ceramic wafer which is too thin is not easy for producing and is easy to break. From another aspect considering the insulation strength, the insulation strength of the high-voltage insulation plate is defined to be more than 1500V. High insulation strength is beneficial for reducing the power driver circuit, for example, when the insulation strength is high enough to meet the electrical security requirements, a non isolated power driver circuit can be used, the manufacturing costs can be reduced.

The high-voltage insulation plate can be designed to be integrated with the thermal conductive core via soldering (or adhering), or can be integrated with the heat dispreading plate via soldering (or adhering). According to the second design, the present invention provided an LED chip comprising: a plurality of LED wafers, a heat dispreading plate, an outer insulator, and a high-voltage insulation plate. The LED chip of the present invention has the following character features: the LED wafers are set on Face A of the heat dispreading plate, wherein the heat dispreading plate adopts copper or aluminum material or copper-aluminum composite material, wherein the area of the heat dispreading plate is five times larger than the sum area of the LED wafers on the heat dispreading plate, wherein the thickness of the heat dispreading plate is larger than 0.4 mm. The high-voltage insulation plate is set on Face B of the heat dispreading plate. The high-voltage insulation plate adopts a ceramic wafer which is sintered into ceramics, with a thickness of more than 0.15 mm. The outer insulator is arranged around the peripheral sidewall of the heat dispreading plate and is connected with the high-voltage insulation plate, the whole outer circumferential edge and Face B of said heat dispreading plate are surrounded by said outer insulator and said high-voltage insulation plate so as to be insulated and separated.

Still further objects and advantages will become apparent from a consideration of the ensuing description and drawings.

These and other objectives, features, and advantages of the present invention will become apparent from the following detailed description, the accompanying drawings, and the appended claims.

1 LED wafer; 2 high-voltage insulation plate; 3 heat spreading plate; 301 Face A: 302 Face B; 4 outer insulator; 5 thermal conductive core; 6 lamp housing cover; 7 insulation glue (filling); 8 retention plate; 9 electrical wire; 10 solder or electrical conductive glue; 11 low-voltage insulation layer, 12 electric power input wire; 13 insulation bushing; 14 constant voltage diode; 15 controllable silicon.

DETAILED DESCRIPTION OF THE PREFERRED EMBODIMENT

Figure 1:
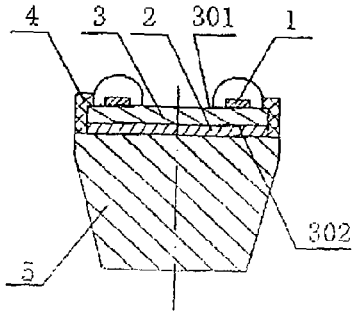
FIG. 1 is the sketch map of the sectional view of one kind LED light module of the present invention, it illustrates the basic structure character of a LED light module of the present invention, wherein the thermal conductive core adopts a conical structure.

As shown in FIG. 1, a LED light module of the present invention is illustrated. The thermal conductive core 5 adopts a conical structure. The heat spreading plate 3 adopts a plain panel structure. Two LED wafers are shown in the drawing and are set on Face A 301 of the heat spreading plate 3. When in design, it should be mentioned that the power of a single LED wafer should not be too large and preferably not larger than 2 W. The wafers should be radially and dispersedly arranged on the heat spreading plate. The outer insulator 4 is provided around the peripheral sidewall of the heat spreading plate. The outer insulator 4, which is extended to the high-voltage insulation plate 2 which is set between Face B 302 of the heat dispreading plate 3 and the thermal conductive core 5, together with the high-voltage insulation plate 2 insulate and separate the heat spreading plate 3 from the thermal conductive core 5 and the outer conductor nearby, so as to provide a high-voltage insulation effect. The insulation strength of the outer insulator 4 should be higher than the insulation strength of high-voltage insulation plate 2. The outer insulator 4 can be embodied as a component, or an insulation coating (glue), or a combination of insulation component and an insulation coating (glue).

Figure 2:
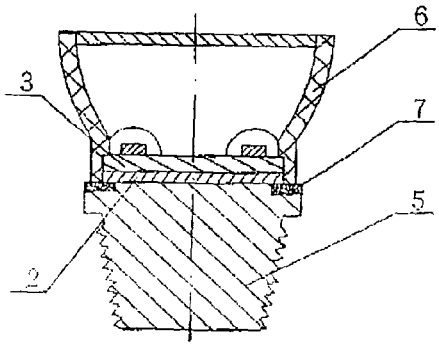
FIG. 2 is the sketch map of a sectional view of one kind LED light module of the present invention, it illustrates a structure to enhance the insulation strength at the peripheral edge of the high-voltage insulation plate.

The high-voltage insulation plate and the outer insulator are two components with two materials respectively. The high-voltage insulation plate has a small thickness (not larger than 0.5 mm). As shown in FIG. 1, the connection between the high-voltage insulation plate 2 and the outer insulator 4 has a low insulation strength and is easy to suffer from a dielectric breakdown. In order to enhance the insulation strength at the connection between the high-voltage insulation plate 2 and the outer insulator 4 (i.e. at the peripheral edge of the high-voltage insulation plate 2), a structure of the present invention light module is illustrated in FIG. 2. The heat adsorption face of the thermal conductive core 5 is designed to have a protruding portion, the size of the peripheral edge of the protruding portion is smaller than the size of the peripheral edge of the high-voltage insulation plate 2, so that a gap is formed therebetween for filling with insulation glue (filling) 7, so as to enhance the insulation strength at the peripheral edge of the high-voltage insulation plate 2.

In the LED light module shown in FIG. 2, the thermal conductive core 5 adopts a tapered spiral column structure, a lamp housing is also provided. The lamp housing cover 6 serves as the outer insulator, so as to cooperate with the insulation glue (filling) 7 to insulate and separate the heat threading plate 3.

Figure 3:
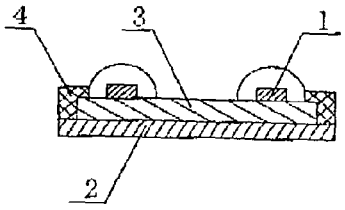
FIG. 3 is the sketch map of a section view of one kind LED chip of the present invention, it illustrates a structure to enhance the insulation strength at the peripheral edge of the high-voltage insulation plate, wherein the outer edge of the high-voltage insulation plate is larger than the heat spreading plate.

The LED chip in FIG. 3 has the following differences in comparison with the light module in FIG. 1: the LED chip is not provided with a thermal conductive core; in order to enhance the insulation strength at the peripheral edge of the high-voltage insulation plate 2, in the LED chip of FIG. 3, the size of the peripheral edge of the high-voltage insulation plate 2 is larger than the size of the peripheral edge of the heat spreading plate 3, so that the creepage distance between the peripheral edge of the heat dispreading plate and heat conduction plate (thermal conductive core and other electrical conductor etc., not shown in the drawings) is increased, and thus the insulation strength is enhanced. When in design, the peripheral edge of the high-voltage insulation plate should be at least 0.5 mm larger than the peripheral edge of the heat spreading plate, so as to provide enough and reliable insulation strength.

Figure 4:
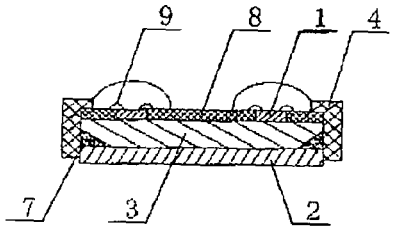
FIG. 4 is the sketch map of a section view of one kind LED chip provided with a retention plate of the present invention, wherein the LED wafers are embedded into the retention plate, and a kind structure is provided to enhance the insulation strength at the peripheral edge of the high-voltage insulation plate.

The LED chip shown in FIG. 4 is provided with a retention plate 8 which has wafer embedding openings. The LED wafers 1, which are respectively embedded into the wafer embedding openings, are attached to Face A of the heat dispreading plate 3 through soldering or adhering (preferably soldering) so as to reduce the thermal resistance between the LED wafers 1 and the heat dispreading plate 3. The retention plate 8, which is made from an insulation plate, is provided with electric circuit and lead wire soldering pads which are adjacent to the electrode soldering pads on the LED wafer. The electrical connection between the two soldering pads can be achieved by electrical wire soldering connection such as ultrasonic gold wire bonding, or other connecting process such as solder soldering and adhering connection via electrical conductive glue. In FIG. 4, the electrical connection between the lead wire soldering pads on the retention plate and the electrode soldering pads on the LED wafers are achieved by electrical wires 9, i.e. through electrical wire soldering connection.

FIG. 4 illustrates another structure for enhancing the insulation strength at the peripheral edge of the high-voltage insulation plate. Face B of the heat spreading plate 3 adopts a chamfering structure. The size of the peripheral edge of the high-voltage insulation plate 2 is larger than the size of the chamfering inner peripheral edge of the heat dispreading plate 3, as shown in the drawings, the size of the high-voltage insulation plat 2 matches with the size of the heat dispreading plate 3, since there is a chamfering structure, a triangular opening is naturally formed. As also shown in the drawing, the triangular opening is filled with insulation glue (filling) 7, so that the insulation strength of the heat dispreading plate at the peripheral edge of the high-voltage insulation plate is further enhanced.

Figure 5:
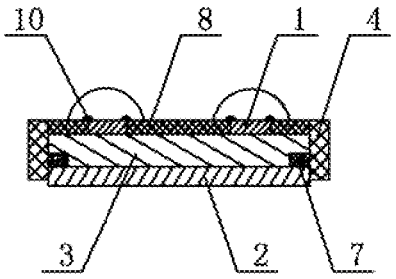
FIG. 5 is the sketch map of a section view of one kind LED chip of the present invention, wherein the LED chip adopts a protruding structure at Face B of the heat spreading plate, so as to enhance the insulation strength at the peripheral edge of the high-voltage insulation plate.

In order to enhance the insulation strength at the peripheral edge of the high-voltage insulation plate, the LED chip of the present invention shown in FIG. 5 adopts a structure similar to the structure shown in FIG. 2. Face B of the heat dispreading plate 3 adopts a protruding portion, the size of the edge of the protruding portion is smaller than the size of the peripheral edge of the high-voltage insulation plate 2, so that a gap is formed between the peripheral edges of the heat dispreading plate 3 and the high-voltage insulation plate 2, as shown in the drawing, the gap is further filled with insulation glue (filling) 7, so that the insulation strength at the peripheral edge of the high-voltage insulation plate is enhanced. The LED chip in FIG. 5 also comprises a retention plate 8. The lead wire soldering pads on the retention plate 8 are connected with the electrode soldering pads on the wafer 1 via solder (or electric conductive glue) 10, i.e. connection via solder soldering or electric conductive glue adhering.

There are two types of LED wafers: one type of the LED wafer includes a substrate which is an electric conductor and has a pn electrode of L-contact (Laterial-contact) which is known as L-type electrode, for example, the substrate of this type of LED wafer is carborundum; the other type of LED wafer includes a substrate which is an insulator and has a pn electrode of V-contact (Vertical-contact) which is known as V-type electrode, for example, the substrate this type of LED wafer is sapphire. If the LED wafers adopt a serial connection structure, and the LED wafers are directly contacting the metal (copper or aluminum) on the heat spreading plate, there is only one choice which is to use LED wafers with an insulation substrate and having a formal structure, as the structures shown in FIGS. 1, 2, 3, 4, and 5. When using a substrate of connector or a substrate of insulator and adopting a flip chip structure, while the LED wafers adopt a serial connection structure, Face A of the heat dispreading plate should be provided with an insulation layer. This is because the heat flux density between the LED wafers and the Face A of the heat spreading plate is relatively high, in order to reduce the heat conduction temperature difference thereof, the insulation layer should have a small thickness, so that the insulation strength thereof is relatively low, and thus the insulation layer thereof is defined as a low-voltage insulation layer.

Ceramic membranes which are produced through vapor deposition process such as diamond, SiC, AiN, BN, BeO, Al2O3 are compact in substance and have good electrical insulation and heat conduction performances, especially, diamond, SiC, AiN, BN, and BeO which are high heat conduction ceramics, can be used as the low-voltage insulation layer on Face A of the heat spreading plate. The vapor deposition process can be physical vapor deposition process or chemical vapor deposition process, both of them are suitable for preparing the low-voltage insulation layer of the present invention.

Although the ceramic membranes produced through vapor deposition process are compact in substance and have good insulation and heat conduction performances, the thickness of the ceramic membranes are small (several micro), the manufacturing costs are relatively high. The manufacturing costs of ceramic membrane which can endure hundreds of voltages (the thickness of the membrane should be thinker than 10 μm) are even higher. When adopting the anodic oxidation process for directly growing alumina membrane on the metal aluminum on the surface of the heat dispreading plate so as to produce the low-voltage insulation layer. Although the heat conduction performance of the alumina membrane is not high as the membrane produced by vapor deposition process, the manufacturing costs are low and it is easy to obtain a thicker membrane, the insulation strength thereof can be more than 100V. When in design, the thickness of the alumina membrane serving as the low-voltage insulation layer should be smaller than 50 μm so as to control the heat conduction resistance thereof.

Although copper is more expensive than aluminum and harder for processing into a desired shape, the amount of materials required for the heat dispreading plate is relatively few and the outer appearance is simple (plate shaped) and the manufacturing process is easy. More importantly, the thermal flux density of the LED wafers is relatively high, the material of the high heat conduction is more important, so that the heat dispreading plate should adopt copper first. In order to create an alumina insulation layer with anodic oxidation process on the surface of the copper heat dispreading plate, a copper and aluminum composite material should be introduced. In other words, the copper plate is coated with an aluminum layer on the surface thereof. The aluminum layer on Face A of the heat dispreading plate should have a small thickness as long as the thickness is capable for providing aluminum which is required for the anodic oxidation process.

Figure 6:
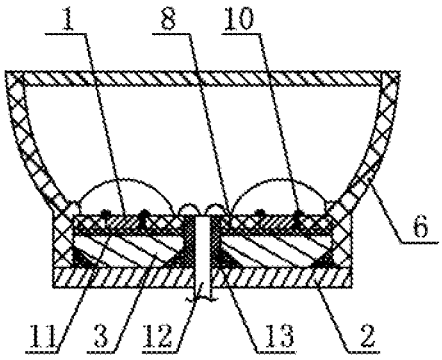
FIG. 6 is the sketch map of a section view of one kind LED chip of the present invention, wherein Face A of the heat spreading plate is provided with a low-voltage insulation layer.

In the LED chip shown in FIG. 6, Face A of the heat dispreading plate 3 is provided with a low-voltage insulation layer 11 which can be ceramic membrane produced through vapor deposition process or alumina membrane which is grown directly from metal aluminum on the surface of the heat dispreading plate 3 through anodic oxidation process.

As also shown in FIG. 6, a lamp housing cover 6 is provided and used as the outer insulator. The peripheral edge of Face B of the heat dispreading plate 3 adopts a chamfering structure, the insulation glue (filling) 7 is also introduced and the peripheral edge of the high-voltage insulation plate 2 is larger then the peripheral edge of the heat dispreading plate 3, so that the insulation strength at the peripheral edge of the high-voltage insulation plate 2 is enhanced. Referring to the drawings, the electric power input wire 12 of the LED wafers 1 passes through the high-voltage insulation plate 2, the heat dispreading plate 3 and the retention plate 8, and the electric power input wires 12 is connected with the electric circuit on the retention plate 8. An insulation bushing 13 is also adopted, and a chamfering structure is introduced on the heat dispreading plate 3 at the penetrating hole site of the electric power input wire 12, so as to from triangular openings for filling with insulation glue (filling), so as to enhance the insulation strength thereof.

When a flip chip structure is used, if a retention plate is employed and the lead wire soldering pads are located on the surface of the retention plate, an electrode soldering pad on the LED wafer should be provided on the sidewall of the LED wafer, solder soldering or electrical conductive glue adhering can be employed for providing the electrical connection between the lead wire soldering pads on the retention plate and the electrode soldering pads on the LED wafers. As shown in FIG. 6, the electrode soldering pad at a side of the LED wafer 1 is provided on the sidewall of the LED wafer, this situation is suitable for a LED wafer with an insulator substrate.

Figure 7:
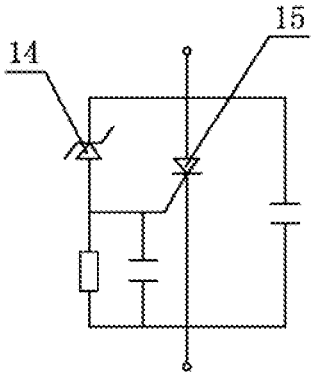
FIG. 7 is a circuit drawing illustrating a circuit diagram of an LED wafer circuit break safety element.

The LED light module or LED chip of the present invention comprises a plurality of LED wafers which can be serially connected. When one of the LED wafers ceases to be in effect or a break in the circuit is produced, the operation of the module or chip is influenced. Therefore, it is preferred to provide a circuit break safety element which is in parallel connection with each of or a plurality of the LED wafers. FIG. 7 illustrates a circuit diagram of an LED wafer circuit break safety element, when the LED wafer which is in parallel connection with the circuit break safety element is out of work and a broken circuit is produced, when the voltage amounts high to be in excess of the stable voltage of the constant voltage diode 14 (the stable voltage can be preset to be 1.5 times of the working voltage when the LED is in normal operation, or even higher), the constant voltage diode 14 is connected to actuate the connection of the controllable circuit 15, so that the electric current can move around the LED wafer which is out of work or having a broken circuit, so that the normal operation of other LED wafers can be ensured.

The circuit break safety element can be provided on the surface of the retention plate. Also, the installation of circuit break safety element may adopt the embedding structure similar to the LED wafers in the retention plate shown in FIGS. 4, 5, and 6. The retention plate can be furthered provided with or embedded with temperature sensing element for keeping the temperature of the LED wafers be not excess of a predetermined temperature. For example, A PTC element can be used, so that when the sensed temperature is excess of a preset value, the electric current is cut off. When the temperature sensing element is a thermocouple, a thermal resistance, or a thermistor, the detected temperature signals can be sent to the actuation electric power so as to adjust the actuation current. The retention plate also can be provided with or embedded with other protection elements (such as electrostatic prevention element). One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A LED light module including a plurality of LED wafers, an outer insulator, a high-voltage insulation plate consisting essentially of a ceramic wafer with a thickness of more than 0.15 mm, a thermal conductive core, a heat dispreading plate consisting essentially of copper, or aluminum, or copper-aluminum composite material and having Face A and Face B for said high-voltage insulation plate to be attached to, said heat dispreading plate is a plate that, the area of said heat dispreading plate is five times larger than the sum area of said LED wafers on said heat dispreading plate, and said LED wafers are set directly on Face A of said heat dispreading plate, or Face A of said heat dispreading plate is provided with a low-voltage insulation layer, the thickness of said low-voltage insulation layer is not larger than 50 μm, said LED wafers are set directly on said low-voltage insulation layer, said high-voltage insulation plate is a wafer that is attached directly on Face B of said heat dispreading plate, and is set between said heat dispreading plate and said thermal conductive core, and is attached directly on the heat absorption face of said thermal conductive core, said outer insulator is a part that, by which the whole peripheral sidewall of said heat dispreading plate is surrounded, and is in company with said high-voltage insulation plate to make the whole outer circumferential edge and Face B of said heat dispreading plate to be insulated and separated from said thermal conductive core, characterized in that:

wherein the whole peripheral edge of said high-voltage insulation plate has any kind of the four insulation strength enhancing structures listed below:

the heat adsorption face of said thermal conductive core is provided with a protruding portion, wherein the size of the peripheral edge of said protruding portion is smaller than the size of the peripheral edge of said high-voltage insulation plate, the size of the peripheral edge of said high-voltage insulation plate is larger than the size of the peripheral edge of said heat dispreading plate, the peripheral edge of Face B of said heat dispreading plate adopts a chamfering structure, Face B of said heat dispreading plate adopts a protruding portion, wherein the size of the peripheral edge of the protruding portion is smaller than the size of the peripheral edge of said high-voltage insulation plate.

2. The LED light module, as recited in claim 1, wherein the area of said heat dispreading plate is ten times larger than the sum area of said LED wafers on said heat dispreading plate.

3. The LED light module, as recited in claim 2, wherein the thickness of said heat dispreading plate is larger than 0.4 mm.

4. The LED light module, as recited in claim 1, wherein the thickness of said heat dispreading plate is larger than 0.4 mm.

5. A LED chip including a plurality of LEO wafers, an outer insulator and a high-voltage insulation plate consisting essentially of a ceramic wafer with a thickness of more than 0.15 mm, a heat dispreading plate consisting essentially of copper, or aluminum, or copper-aluminum composite material and having Face A and Face B for said high-voltage insulation plate to be attached to, said heat dispreading plate is a plate that, the area of said heat dispreading plate is five times larger than the sum area of said LED wafers on said heat dispreading plate, and said LED wafers are set directly on Face A of said heat dispreading plate, or Face A of said heat dispreading plate is provided with a low-voltage insulation layer, the thickness of said low-voltage insulation layer is not larger than 50 μm, said LED wafers are set directly on said low-voltage insulation layer, said high-voltage insulation plate is a wafer that is attached directly on Face B of said heat dispreading plate, said outer insulator is a part that, by which the whole peripheral sidewall of said heat dispreading plate is surrounded, and is in company with said high-voltage insulation plate to make the whole outer circumferential edge and Face B of said heat dispreading plate to be insulated and separated from said thermal conductive core, characterized in that:

wherein the thickness of said heat dispreading plate is larger than 0.4 mm.

6. The LED chip, as recited in claim 5, wherein the electric power input of said LED wafers goes to outside by passing through said high-voltage insulation plate.

7. The LED chip, as recited in claim 5, wherein the area of said heat dispreading plate is ten times larger than the sum area of said LED wafers on said heat dispreading plate.

8. The LED chip, as recited in claim 5, wherein a retention plate with wafer embedding openings is provided, wherein said LED wafers, which are respectively embedded into said wafer embedding openings, are attached to Face A of said heat dispreading plate through soldering or adhering process, wherein said retention plate, which is made from an insulation plate, is provided with an electric circuit and a lead wire soldering pad, there is an electrical connection between said lead wire soldering pad and the electrode soldering pad on said LED wafer.

9. The LED chip, as recited in claim 8, wherein said electrical connection between said lead wire soldering pad and the electrode soldering pad on said LED wafer is achieved by solder soldering connection.

10. The LED chip, as recited in claim 8, wherein said electrical connection between said lead wire soldering pad and the electrode soldering pad on said LED wafer is achieved by adhering connection via an electric conductive glue.

11. A LED chip including a plurality of LED wafers, an outer insulator and a high-voltage insulation plate consisting essentially of a ceramic wafer with a thickness of more than 0.15 mm, a heat dispreading plate consisting essentially of copper, or aluminum, or copper-aluminum composite material and having Face A and Face B for said high-voltage insulation plate to be attached to, said heat dispreading plate is a plate that, the area of said heat dispreading plate is five times larger than the sum area of said LED wafers on said heat dispreading plate, and said LED wafers are set directly on Face A of said heat dispreading plate, or Face A of said heat dispreading plate is provided with a low-voltage insulation layer, the thickness of said low-voltage insulation layer is not larger than 50 μm, said LED wafers are set directly on said low-voltage insulation layer, said high-voltage insulation plate is a wafer that is attached directly on Face B of said heat dispreading plate, said outer insulator is a part that, by which the whole peripheral sidewall of said heat dispreading plate is surrounded, and is in company with said high-voltage insulation plate to make the whole outer circumferential edge and Face B of said heat dispreading plate to be insulated and separated from said thermal conductive core, characterized in that:

wherein the whole peripheral edge of said high-voltage insulation plate has any kind of the three, insulation strength enhancing structures, listed below:

the size of the peripheral edge of said high voltage insulation plate is larger than the size of the peripheral edge of said heat dispreading plate, the peripheral edge of Face B of said heat dispreading plate adopts a chamfering structure, Face B of said heat dispreading plate adopts a protruding portion, wherein the size of the peripheral edge of the protruding portion is smaller than the size of the peripheral edge of said high-voltage insulation plate.

12. The LED chip, as recited in claim 11, wherein the electric power input of said LED wafers goes to outside by passing through said high-voltage insulation plate.

13. The LED chip, as recited in claim 11, wherein the area of said heat dispreading plate is ten times larger than the sum area of said LED wafers on said heat dispreading plate.

14. The LED chip, as recited in claim 11, wherein said low-voltage insulation layer is a ceramic insulation membrane which is produced through vapor deposition process.

15. The LED chip, as recited in claim 11, wherein the thickness of said heat dispreading plate is larger than 0.4 mm.

16. The LED chip, as recited in claim 11, wherein a ceramic wafer adopted by said high-voltage insulation plate is alumina ceramic wafer which is sintered into ceramics.

17. The LED chip, as recited in claim 11, wherein said low-voltage insulation layer is an alumina membrane which is grown directly from metal aluminum on the surface of said heat dispreading plate through anodic oxidation process.

18. The LED chip, as recited in claim 11, wherein a retention plate with wafer embedding openings is provided, wherein said LED wafers, which are respectively embedded into said wafer embedding openings, are attached to Face A of said heat dispreading plate through soldering or adhering process, wherein said retention plate, which is made from an insulation plate, is provided with an electric circuit and a lead wire soldering pad, there is an electrical connection between said lead wire soldering pad and the electrode soldering pad on said LED wafer.

19. The LED chip, as recited in claim 18, wherein said electrical connection between said lead wire soldering pad and the electrode soldering pad on said LED wafer is achieved by a process selected from the group consisting of solder soldering connection, adhering connection via an electric conductive glue.

20. The LED chip, as recited in claim 11, wherein the LED chip is further provided with a lamp housing, wherein a cover of said lamp housing is integrated with said outer insulator to form an integral part.

* * * * *